United States Patent [19]

Stimac et al.

[11] 4,381,794

[45] May 3, 1983

[54] INDUSTRIAL WASHER STRUCTURE

[75] Inventors: John F. Stimac, Milford; Paul E. Goulet, Mason, both of Mich.

[73] Assignee: Industrial Metal Fabricators Co., Detroit, Mich.

[21] Appl. No.: 199,741

[22] Filed: Oct. 23, 1980

[51] Int. Cl.[3] ..... B08B 13/00

[52] U.S. Cl. ..... 134/67; 49/362; 134/111; 134/113; 134/200

[58] Field of Search ..... 134/10, 25.4, 32, 61, 134/62, 67, 68, 104, 111, 113, 126, 200; 49/362, 410, 360

[56] References Cited

U.S. PATENT DOCUMENTS

| | | | |
|---|---|---|---|
| 2,017,677 | 10/1935 | Webb | 134/200 X |
| 2,598,074 | 5/1952 | Sadwith | 134/111 X |
| 2,710,186 | 6/1955 | Maurer | 49/362 X |
| 3,913,268 | 10/1975 | Paterson | 49/360 |

FOREIGN PATENT DOCUMENTS

| | | | |
|---|---|---|---|
| 1016443 | 1/1966 | United Kingdom | 134/62 |
| 2006913 | 5/1979 | United Kingdom | 134/25.4 |

*Primary Examiner*—Richard V. Fisher

*Attorney, Agent, or Firm*—Barnes, Kisselle, Raisch, Choate, Whittemore & Hulbert

[57] ABSTRACT

An industrial washer including structure for and method of automatically moving a cover of the industrial washer to permit rapid exhaust of washing fluid fumes from the washer to facilitate inspection and maintenance of the washer. The structure for removing the cover specifically includes independent rack and pinion means at opposite sides of covers at both ends of the washer for rolling the covers independently parallel to a conveyor moving engine blocks through the washer. The method of the invention includes selectively, independently rolling the covers parallel to the conveyor on mating track and rollers by the rack and pinion means to expose significant portions of the interior of the washer to rapidly exhaust fumes from the washer.

11 Claims, 9 Drawing Figures

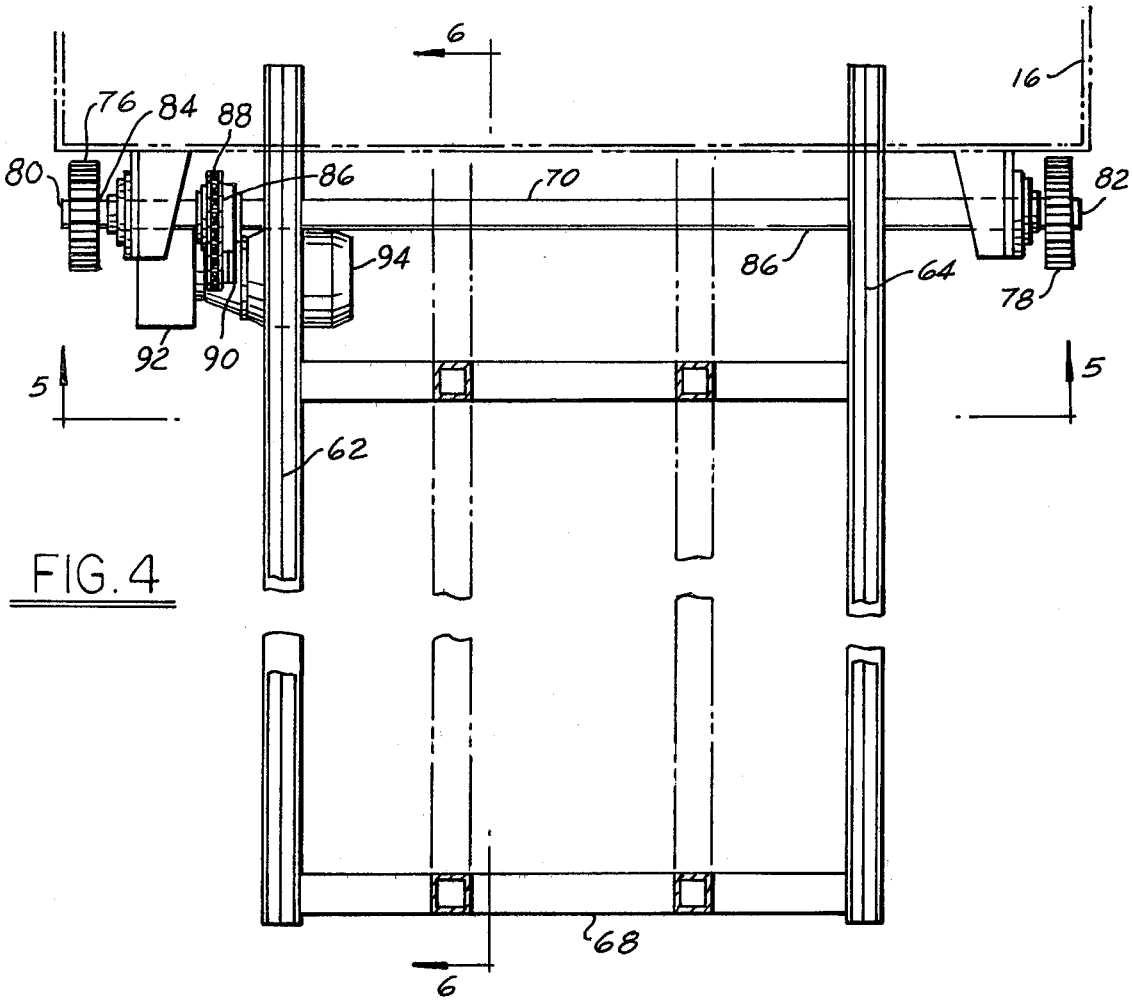
FIG. 4
FIG. 5
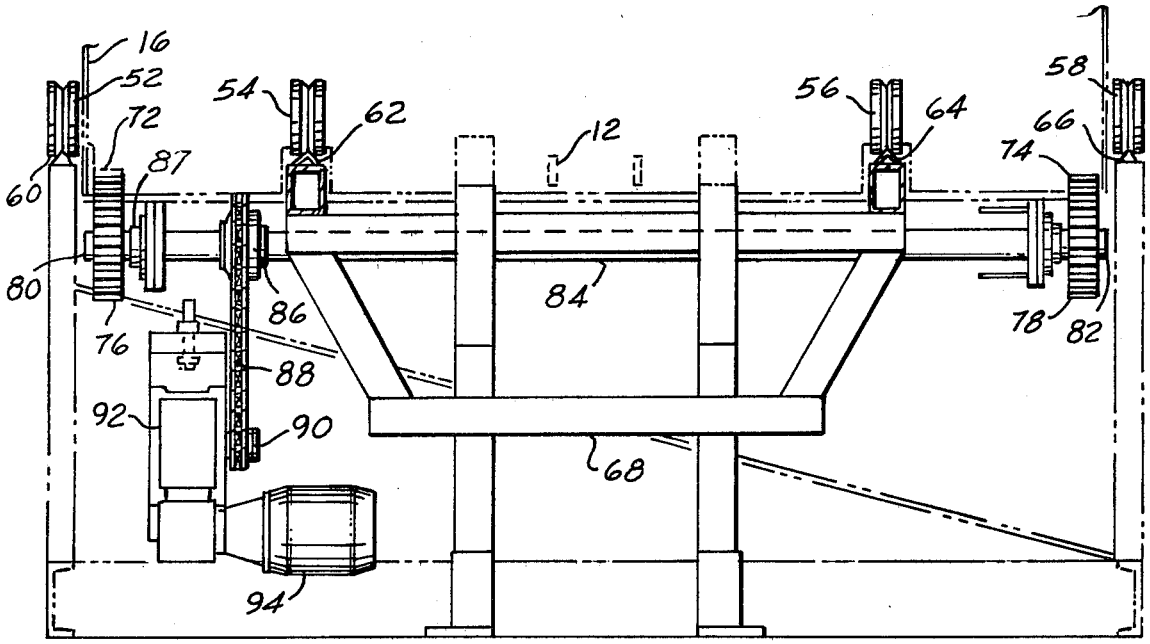

INDUSTRIAL WASHER STRUCTURE

BACKGROUND OF THE INVENTION

1. Field of the Invention

The invention relates to industrial washers and refers more specifically to an industrial washer of the type wherein engine blocks are fed through the washer on a conveyor which is intermittently driven to move the engine blocks between predetermined stations, and wherein the engine blocks are cleaned and washed in the industrial washer beneath large covers over the conveyor and blocks. The invention refers more particularly to such an industrial washer including structure therein for and the method steps of selectively moving the covers to expose a significant portion of the conveyor and operably associated engine block handling apparatus for inspection and or maintenance of the blocks or apparatus whereby downtime of the industrial washer while fumes are being evacuated therefrom to permit inspection and/or maintenance thereof is substantially reduced.

2. Description of the Prior Art

In the past, industrial washers of, for example, the type utilized to clean and wash engine blocks wherein engine blocks are indexed through a washer on a conveyor through a plurality of stations, both on and off the conveyor, for treatment by washing fluid or the like, have included covers over the conveyor, associated engine block handling apparatus, and/or cleaning and washing apparatus to restrict cleaning and washing fluids and their fumes substantially to the industrial washer.

With such structure, when it is desired to inspect the conveyor or associated engine block handling apparatus such as ferris wheel structures and the like for proper operation and/or to provide maintenance thereon, the industrial washer has had to be shut down while the fumes from the fluids used in the washer are evacuated therefrom prior to entry of personnel into the covered area to perform the inspection and/or maintenance. Costs for downtime of such industrial washers may run to hundreds of dollars per minute of downtime. Therefore, anything that can be accomplished to eliminate portions of such downtime is particularly desirable.

Further, with such structures of the past, wherein doors have been provided in the covers of such apparatus, and maintenance is carried on inside the apparatus by personnel entering the covers through the doors, the working space within the covers has usually been cramped, resulting in disagreeable working conditions and therefore longer downtime and low employee morale.

SUMMARY OF THE INVENTION

In accordance with the present invention, an industrial washer for washing engine blocks and the like and method of operation thereof is provided in significant portions of the conveyor and engine block handling apparatus of the washer may be selectively exposed to rapidly dissipate fumes which prevent inspection and maintenance of the structure from the area of the conveyor and associated engine block handling apparatus and to provide substantially unlimited space for inspection and maintenance.

The structure of the invention comprises covers on an industrial washer for engine blocks or the like in which washer engine blocks are indexed through a plurality of stations, both on and off a conveyor beneath the covers in a closed position, which covers are mounted on rollers which are set on tracks extending parallel to the conveyor, whereby the covers may be moved parallel to the conveyor on the tracks. The invention also includes racks secured to opposite sides of each of the covers in mesh with pinions on a spindle associated with each cover, and means for driving the spindles through chain and sprocket apparatus independently for each cover.

The method of the invention includes moving the covers of an industrial washer, in which washer engine blocks are moved therethrough in a plurality of stations, both on and off a conveyor, longitudinally of the conveyor by selectively energizing motors to turn spindles having pinions on opposite ends thereof engaged with racks secured to the covers to roll the covers parallel to the conveyor on tracks positioned parallel to the conveyor and mating wheels secured to the covers and positioned on the tracks.

BRIEF DESCRIPTION OF THE DRAWINGS

FIG. 4 is an enlarged partial top view of structure for moving the left hand cover of the industrial washer as illustrated in FIG. 2 to expose a significant portion of the conveyor and engine block handling apparatus within the washer for inspection and/or maintenance in accordance with the method of the invention.

FIG. 5 is a partial section view of the structure illustrated in FIG. 4 taken substantially on the line 5—5 in FIG. 4.

DESCRIPTION OF THE PREFERRED EMBODIMENT

Figure 1:
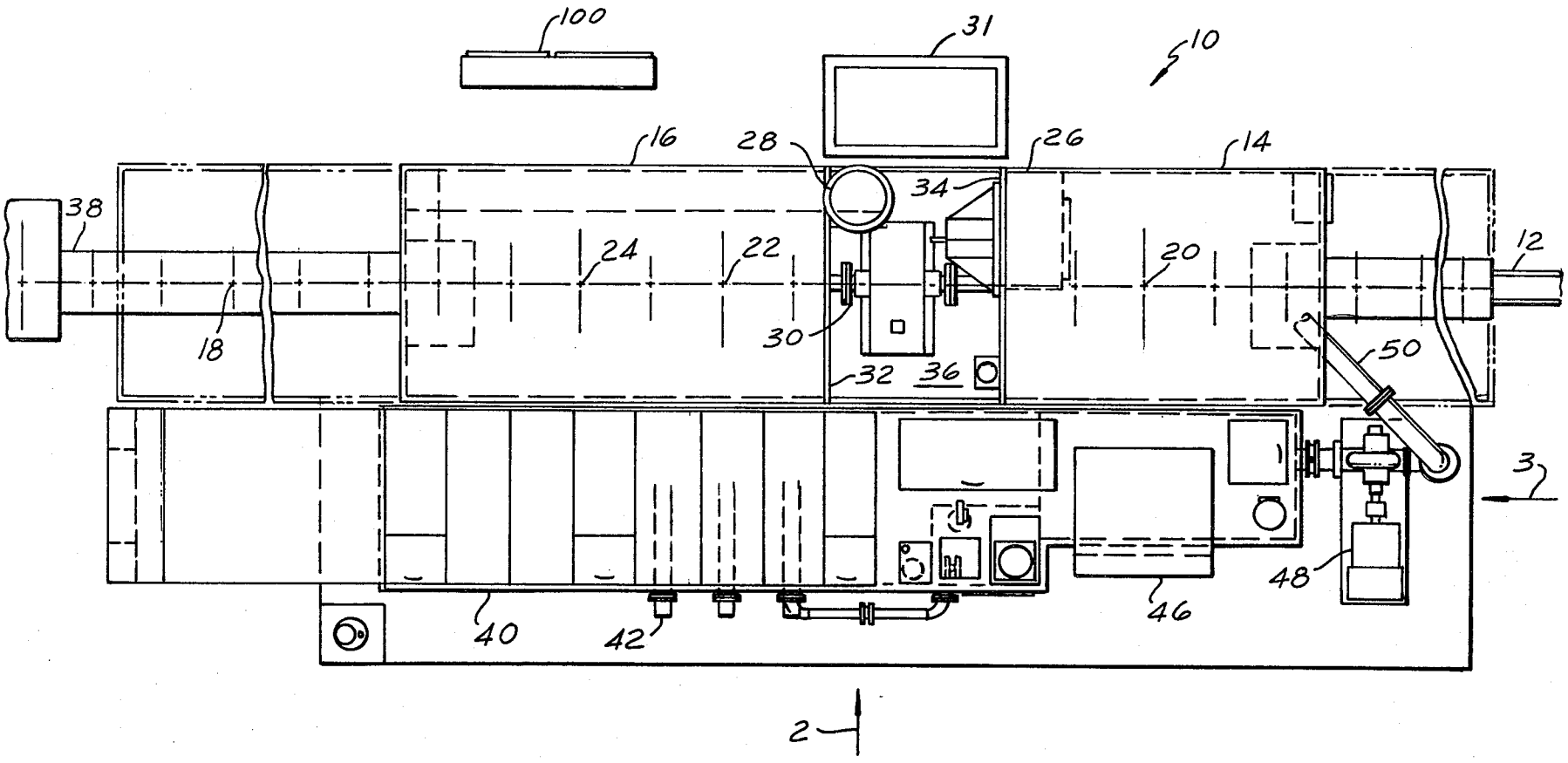
FIG. 1 is a top view of the industrial washer structure of the invention for practicing the method of the invention.
Figure 2:
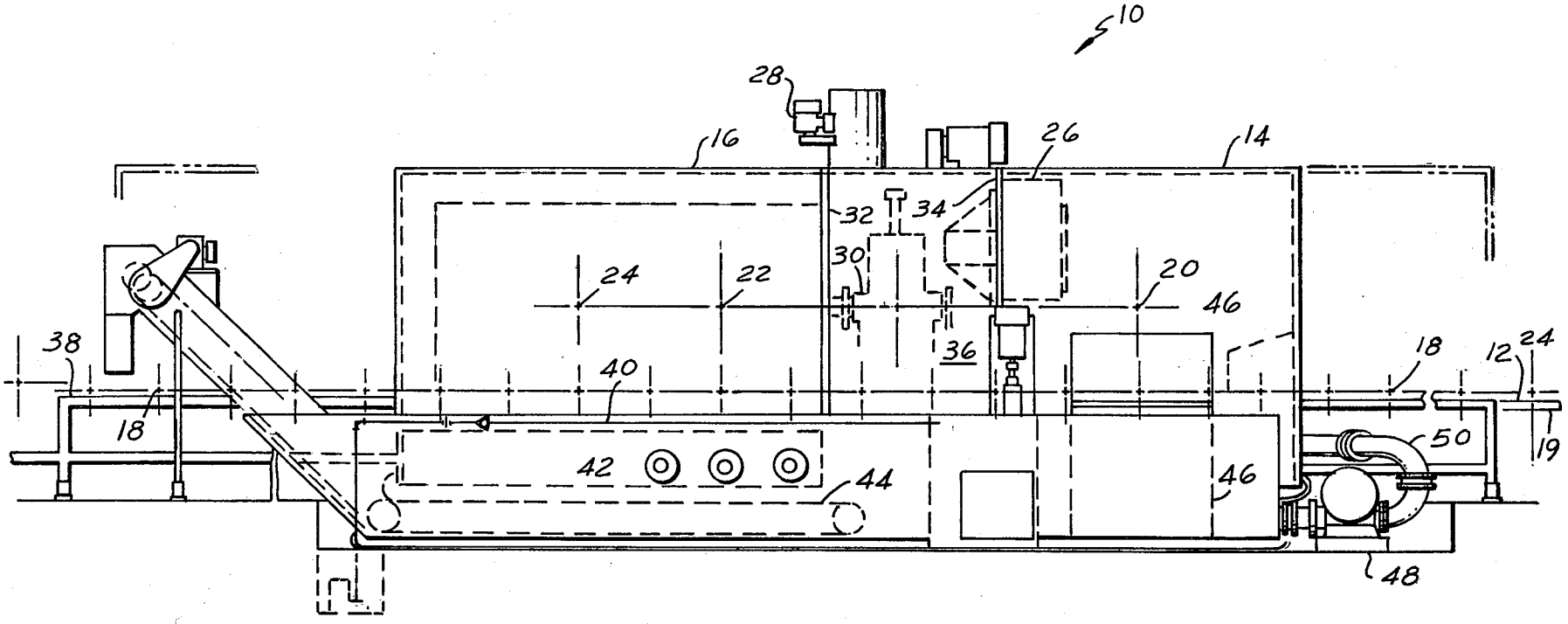
FIG. 2 is a side view of the industrial washer structure of FIG. 1 taken substantially in the direction of arrow 2 in FIG. 1.
Figure 3:
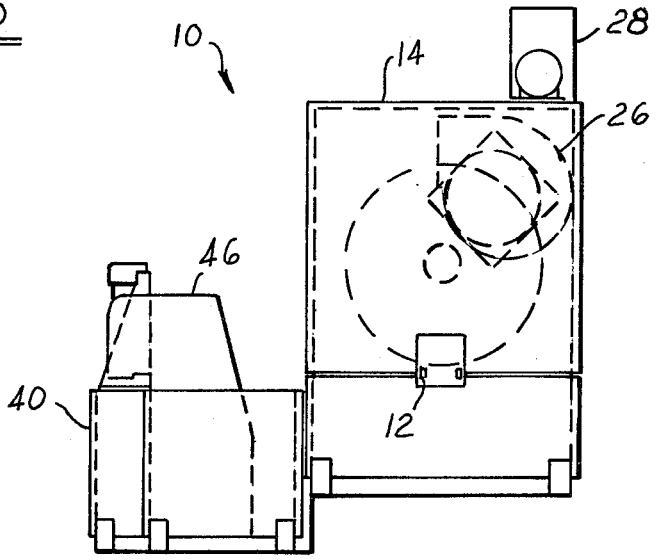
FIG. 3 is an end view of the industrial washer structure illustrated in FIG. 1 taken substantially in the direction of arrow 3 in FIG. 1.

The industrial washer 10 of the invention as shown in FIGS. 1 through 3 is operable to receive engine blocks from conveyor 12 and to clean them under a cover 14 and to wash them under a cover 16 while moving the engine blocks through a plurality of stations 18, both on and off the conveyor 12.

In accordance with the invention, the industrial washer 10 includes structure for effecting a method of moving the covers 14 and 16 independently parallel to the conveyor 12 to selectively expose a significant portion of the conveyor 12 and associated engine block handling apparatus, whereby fumes from cleaning and washing fluids are rapidly evacuated from the area of the conveyor and engine block handling apparatus to facilitate rapid inspection and/or maintenance of the washer.

More specifically, the industrial washer 10 includes ferris wheel engine block handling apparatus at stations 20, 22 and 24 wherein engine blocks on conveyor 12 are removed from and replaced on the conveyor. Engine blocks are removed from the conveyor 12 at stations 20, 22 and 24 and are rotated into a plurality of positions defining a plane transverse to the conveyor 12 and are cleaned beneath the cover 14 and washed beneath the cover 16.

A dry-off fan structure 26 and exhaust fan structure 28, as well as fluid flow control structure 30, which may be actuated by hydraulic control structure 31, are provided between the stationary bulkheads 32 and 34 in the center of the industrial washer 10 as shown.

In operation of the industrial washer 10, the engine blocks are first moved from end 19 of the conveyor 12 to a ferris wheel apparatus at the station 20 under the cover 14, at which station the blocks are rotated into a plurality of different attitudes whereby they are emptied of extraneous fluids and chips that may be carried thereby into the industrial washer. The engine blocks are then placed back on the conveyor 12 and dried in the area 36 between the bulkheads 32 and 34.

Subsequently, the engine blocks are indexed beneath the cover 16 and through the various positions shown and the ferris wheel structures at the positions 22 and 24. The engine blocks are washed beneath the cover 16 with a washing fluid while they are in different attitudes on ferris wheel structures at stations 22 and 24. The cleaned and washed engine blocks are then moved out of the industrial washer 10 at the end 38 of the conveyor 12.

Industrial washer 10 further includes the tank 40 for holding the washing fluid which may be a caustic washing fluid. The fluid is heated by heaters 42 and is filtered by the filter bed 44 and the filter 46 in the tank 40, after which it is pumped by motor and pump means 48 through a conduit 50 back into the area beneath the cover 16 of the industrial washer 10 through the structure 30.

The operation of the industrial washer 10 as indicated above is substantially continuous. However, when it is necessary to shut down the conveyor 12 to inspect either the industrial washer structure 10 or the engine blocks passing therethrough during operation, it is essential that the inspection and/or any maintenance required be accomplished as quickly as possible since downtime of the conveyor 10 in most engine plants is expensive. Unscheduled downtime due to unexpected occurrences in the washer structure 10 often costs several hundreds of dollars per minute.

As set forth above, in the past when it has been necessary to inspect or provide maintenance, particularly unscheduled inspection and/or maintenance on or in industrial washers, it has been necessary to evacuate the area beneath the covers 14 and/or 16 with fans or the like before permitting workmen inside the covers 14 and 16 through doors therein. Such inspection and/or maintenance has been carried out under the covers in such prior industrial washers under undesirable conditions due to cramped quarters and residual fumes therein.

In accordance with the present invention, structure is provided in the industrial washer 10 for moving the covers 14 and 16 parallel to the conveyor 12 between the closed positions shown in full lines in FIGS. 1 and 2 and the open positions shown in phantom in FIGS. 1 and 2, whereby a significant portion of the conveyor 12 and the engine block handling apparatus within the industrial washer 10 is exposed for rapid evacuation of fumes and to provide additional working space for maintenance operations.

Figure 6:
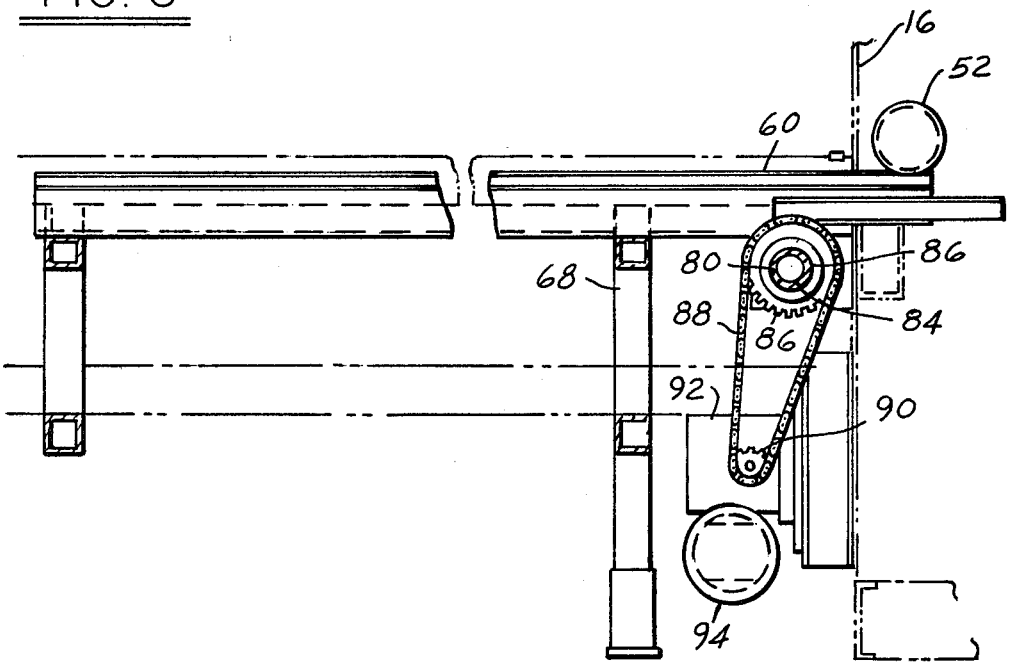
FIG. 6 is a partial section view of the structure illustrated in FIG. 4 taken substantially on the line 6—6 in FIG. 4.
Figure 7:
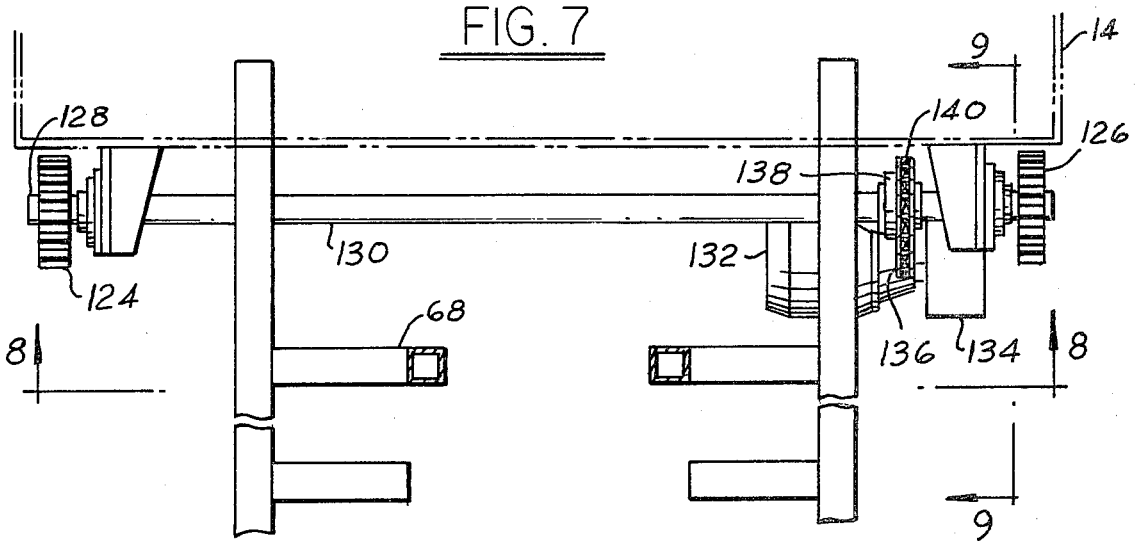
FIG. 7 is an enlarged partial top view of structure for moving the right hand cover of the industrial washer as illustrated in FIG. 2 to expose a significant portion of the conveyor and engine block handling apparatus within the washer for inspection and/or maintenance in accordance with the method of the invention.
Figure 8:
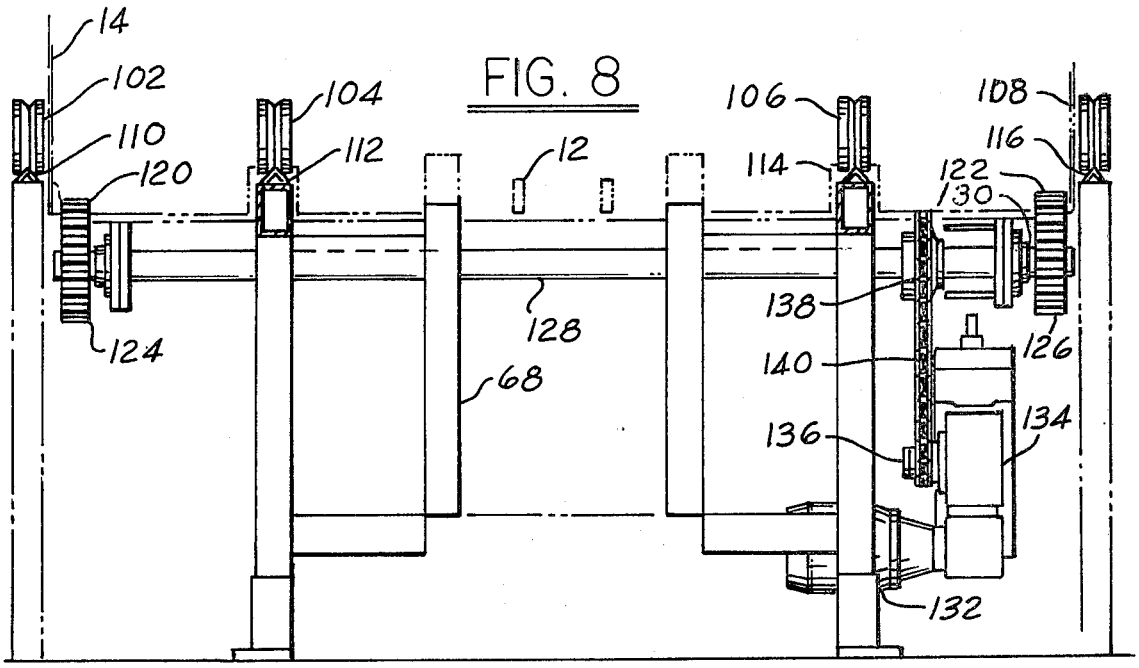
FIG. 8 is a partial section view of the structure illustrated in FIG. 7 taken substantially on the line 8—8 in FIG. 7.
Figure 9:
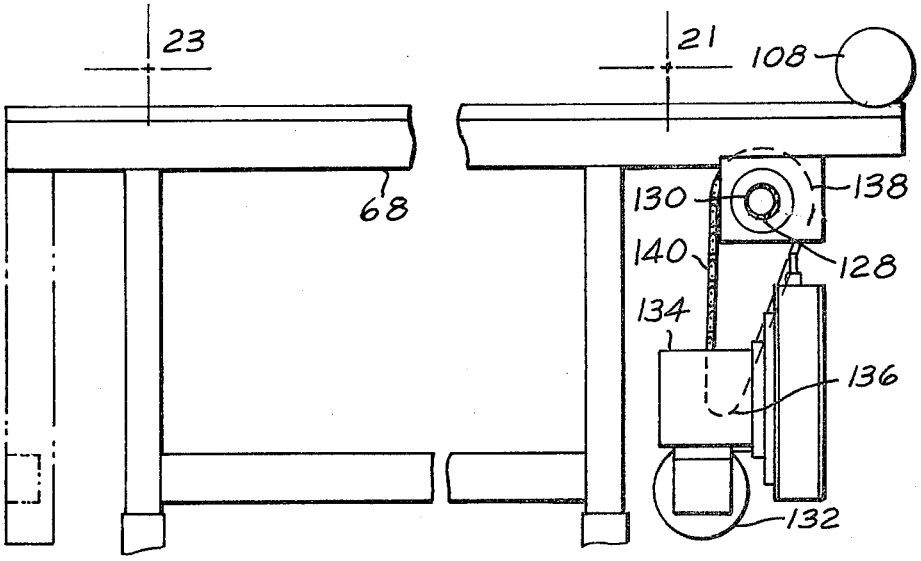
FIG. 9 is a partial section view of the structure illustrated in FIG. 7 taken substantially on the line 9—9 in FIG. 7.

More specifically, as shown in FIGS. 4–6, the structure for moving the cover 16 to the left as shown in FIG. 2 away from the bulkhead 32 against which it is sealed in a closed position to the open position illustrated in phantom in FIG. 2, includes the rear rollers 54 and 56 and the front rollers 52 and 58 spaced apart longitudinally and positioned transversely of the conveyor 12 as shown and rotatably secured to and supporting the cover 16 on rear rails 62 and 64 and front rails carried by the frame 68 of the industrial washer 10. The rollers 52-58 and rails 60-66 have cooperating engaged V-shaped surfaces which insure that the cover 16 is guided parallel to the conveyor 12 on the frame 68.

Movement of the cover 16 between the open and closed positions thereof as shown in full and phantom lines respectively in FIG. 2, is accomplished by rack and pinion means. The rack and pinion means includes racks 72 and 74 secured to the cover 16 parallel to the conveyor 12 and pinions 76 and 78 meshed therewith supported for rotation on the opposite ends 80 and 82 of the spindle structure 84. Spindle structure 84 includes bearing means 87 secured to the frame 68 as shown. In operation, the pinions 76 and 78 are rotated on rotation of the spindle means 84 in the bearing means 87.

The spindle structure 84 is connected to the sprocket 86 for rotation within the bearing means 87 to rotate pinions 76 and 78. Sprocket 86 is in turn rotated through drive chain 88, sprocket 90, gearbox 92 and motor 94.

Thus, in operation, the reversible motor 94 is selectively driven in opposite directions automatically on operation of electrical controls in control cabinet 100 to rotate the pinions 76 and 78 in a required direction to cause the cover 16 secured to the racks 72 and 74 to move into a closed position as shown in solid lines in FIG. 2 wherein the open end thereof is sealed against the bulkhead 32 or to move into an open position of the cover as shown in phantom in FIG. 2 to expose a significant portion of the conveyor 12 and associated engine block handling apparatus including ferris wheel apparatus at stations 22 and 24 to facilitate rapid inspection and maintenance of the industrial washer 10.

Similarly, the structure for effecting movement of the cover 14 into a closed position wherein the open end thereof is sealed against the bulkhead 34, as shown in full lines in FIG. 2, and an open position as shown in phantom in FIG. 2, includes the rear rollers 104 and 106 and front rollers 102 and 108 having a V-shaped outer periphery cooperable with the V-shaped tracks 110, 112, 114 and 116 to guide the cover 14 to the conveyor 12 in its movement on frame 68.

Again the movement of the cover 14 is accomplished through rack and pinion means including racks 120 and 122 secured to the cover 14 and pinions 124 and 126 engaged therewith. Said pinions are rotatably mounted on the spindle structure 128 in bearing means 130.

The spindle structure 128 and pinions 124 and 126 secured thereto are rotated from motor 132 which may be selectively actuated in opposite directions from the control box 100 to drive the gearbox 134, sprocket 136 and sprocket 138 through chain drive 140.

Movement of the covers 14 and 16 parallel to the conveyor 12 to expose the conveyor 12 and engine block handling apparatus of the industrial washer 10 promotes rapid evacuation of the fumes from cleaning and washing fluids from beneath the covers 14 and 16 and therefore permits quicker inspection and/or maintenance within the industrial washer 10. The more rapid inspection and maintenance possible is cost advantageous, particularly during unscheduled shutdowns of the industrial washer 10.

While one embodiment of the present invention has been disclosed in detail herein, it will be understood that other embodiments and modifications thereof are contemplated. It is the intention to include all embodiments and modifications as are defined by the appended claims within the scope of the invention.

We claim:

1. In an industrial washer for engine blocks or the like including a conveyor for receiving engine blocks and indexing them longitudinally through the industrial washer structure between a plurality of aligned stations including moving and stationary portions wherein washing fluid is circulated around the engine blocks including ferris wheel structure for orienting the engine blocks in a plurality of positions, which washer includes means for retrieving the washing fluid, filtering it and re-using it, and further including a cover over at least part of the conveyor and over at least one of said stations, said cover having a top wall, spaced side walls and an end wall which cover together with stationary portions of said station substantially completely encloses said part of said conveyor and said one station to restrict the washing fluid and fumes therefrom during washing, the improvement comprising means for selectively substantially completely removing the cover from said portion of the conveyor and said one station to provide rapid exhaust of washing fluid fumes from the conveyor and to expose the conveyor and associated engine block handling apparatus for maintenance including tracks parallel to the conveyor and wheels rotatably secured to the cover and positioned on the tracks, said wheels and tracks having mating configurations for guiding the wheels on the tracks, and means engaged with the cover for moving the cover parallel to the conveyor on the tracks.

2. Structure as set forth in claim 1, wherein the means for moving the cover parallel to the conveyor on the tracks is rack and pinion structure and means for pinion rotation.

3. In an industrial washer for engine blocks or the like, including a conveyor for receiving engine blocks and indexing them longitudinally through the industrial washer structure between a plurality of aligned stations wherein washing fluid is circulated around the engine blocks including ferris wheel structure for orienting the engine blocks in a plurality of positions, which washer includes means for retrieving the washing fluid, filtering it and re-using it, and further including covers provided over both ends of the conveyor and over the stations associated therewith, each of said covers having a top wall, spaced side walls and an end wall to substantially completely enclose part of said conveyor and said stations associated therewith to restrict the washing fluid and fumes therefrom during washing, bulkhead means extending transversely across said conveyor between two of said stations, said top and side walls of said covers engaging said bulkhead means in their closed positions and means for selectively independently moving the covers at both ends of the conveyor parallel to the conveyor for exposing different significant portions of the conveyor to provide rapid exhaust of washing fluid fumes from the conveyor and to expose the conveyor and associated engine block handling apparatus for maintenance.

4. Structure as set forth in claim 3, wherein the means for removing the covers comprises tracks parallel to the conveyor and wheels rotatably secured to the covers and positioned on the tracks, said wheels and tracks having mating configurations for guiding the wheels on the tracks, and means engaged with the covers for moving the covers parallel to the conveyor on the tracks.

5. Structure as set forth in claim 4, wherein the means for moving the covers parallel to the conveyor on the tracks is rack and pinion structure and means for pinion rotation.

6. Structure as set forth in claim 5, wherein the rack and pinion structure associated with each cover includes a separate rack on each side of the cover secured to the bottom thereof, a separate pinion engaged with the rack on each side of the cover, a single rotatable spindle, pinions secured on opposite ends of the spindle, a motor, a gearbox connected to the output of the motor, a sprocket on said spindle for rotation therewith, a sprocket secured to the output of the gearbox, and a chain drive operable between the sprockets.

7. In an industrial washer for engine blocks or the like, including a conveyor for receiving engine blocks and indexing them longitudinally through the industrial washer structure between a plurality of aligned stations wherein washing fluid is circulated around the engine blocks including ferris wheel structure for orienting the engine blocks in a plurality of positions, which washer includes means for retrieving the washing fluid, filtering it and re-using it, and further including a cover over at least part of the conveyor and over at least one of said stations, said cover having a top wall, spaced side walls and an end wall to substantially completely enclose said part of said conveyor and said one station to restrict the washing fluid and fumes therefrom during washing, the improvements comprising means for selectively substantially completely removing the cover from said portion of the conveyor and said one station to provide rapid exhaust of washing fluid fumes from the conveyor and to expose the conveyor and associated engine block handling apparatus for maintenance, wherein the means for removing the cover comprises tracks parallel to the conveyor and wheels rotatably secured to the cover and positioned on the tracks, said wheels and tracks having mating configurations for guiding the wheels on the tracks, and means engaged with the cover for moving the cover parallel to the conveyor on the tracks, wherein the means for moving the cover parallel to the conveyor on the tracks is rack and pinion structure and means for pinion rotation wherein the rack and pinion structure includes a separate rack on each side of the covers secured to the bottom thereof, a separate pinion engaged with the rack on each side of the cover, a single rotatably spindle, pinions secured on opposite ends of the spindle, a motor, a gearbox connected to the output of the motor, a sprocket on said spindle for rotation therewith, a sprocket secured to the output of the gearbox, and a chain drive operable between the sprocket.

8. In an industrial washer for engine blocks or the like, including a conveyor for receiving engine blocks and indexing them longitudinally through the industrial washer structure between a plurality of aligned stations wherein washing fluid is circulated around the engine blocks including ferris wheel structure for orienting the engine blocks in a plurality of positions, which washer includes means for retrieving the washing fluid, filtering it and re-using it, and further including a cover over at least part of the conveyor and over at least one of said stations, said cover having a top wall, spaced side walls and an end wall to substantially completely enclose the part of said conveyor and said one station to restrict the washing fluid and fumes therefrom during washing, bulkhead means extending transversely across said conveyor between said one station and an adjacent station, said top and side walls of said cover engaging said bulkhead means in its closed positions and means for selectively substantially completely removing the cover from said portion of the conveyor for exposing different significant portions of the conveyor and said one station to provide rapid exhaust of washing fluid fumes from the conveyor and to expose the conveyor and associated engine block handling apparatus for maintenance.

9. In an industrial washer including a conveyor for receiving parts to be washed and indexing them longitudinally through the industrial washer structure between a plurality of aligned stations, and further including covers provided over both ends of the conveyor and over the stations associated therewith, each of said covers having a top wall, spaced side walls and an end wall to substantially completely enclose the part of said conveyor and said stations associated therewith, bulkhead means extending transversely across said conveyor between two of said stations, said top and side walls of said covers engaging said bulkhead means in their closed positions and means for selectively independently moving the covers at both ends of the conveyor parallel to the conveyor for exposing different significant portions of the conveyor.

10. In an industrial washer, including a conveyor for receiving parts to be washed and indexing them longitudinally through the industrial washer structure between a plurality of aligned stations, and further including a cover over at least part of the conveyor and over at least one of said stations, said cover having a top wall, spaced side walls and an end wall to substantially completely enclose said part of said conveyor and said one station, the improvements comprising means for selectively substantially completely removing the cover from said portion of the conveyor and said one station, wherein the means for removing the cover comprises tracks parallel to the conveyor and wheels rotatably secured to the cover and positioned on the tracks, said wheels and tracks having mating configurations for guiding the wheels on the tracks, and means engaged with the cover for moving the cover parallel to the conveyor on the tracks, wherein the means for moving the cover parallel to the conveyor on the tracks is rack and pinion structure and means for pinion rotation, wherein the rack and pinion structure includes a separate rack on each side of the covers secured to the bottom thereof, a separate pinion engaged with the rack on each side of the cover, a single rotatable spindle, pinions secured on opposite ends of the spindle, a motor, a gearbox connected to the output of the motor, a sprocket on said spindle for rotation therewith, a sprocket secured to the output of the gearbox, and a chain drive operable between the sprockets.

11. In an industrial washer for engine blocks or the like including a conveyor, having two ends, for receiving engine blocks and indexing them longitudinally through the industrial washer structure between a plurality of aligned stations, including moving and stationary portions, wherein washing fluid is circulated around the engine blocks, including ferris wheel structure for orienting the engine blocks in a plurality of positions, which washer includes means for retrieving the washing fluid, filtering it and reusing it, and further including covers over both ends of the conveyor and over at least some of said stations, said covers each having a top wall, spaced sidewalls and an end wall which covers together with stationary portions of said some of said stations substantially completely enclose said ends of said conveyor and said some of said stations to restrict the washing fluid and fumes therefrom during washing, the improvement comprising means for selectively independently substantially completely removing the cover at both ends of the conveyor and said some of said stations parallel to the conveyor to provide rapid exhaust of washing fluid fumes from the conveyor and to expose different significant portions of the conveyor and associated engine block handling apparatus for maintenance.

* * * * *